United States Patent [19]

Holman et al.

[11] 4,201,177

[45] May 6, 1980

[54] COMPOUND BOW

[75] Inventors: Rudolph G. Holman, Leguna Beach; Frank W. Ketchum, Manton, both of Calif.

[73] Assignee: AMF Incorporated, White Plains, N.Y.

[21] Appl. No.: 858,138

[22] Filed: Dec. 7, 1977

[51] Int. Cl.[2] ..... F41B 5/00

[52] U.S. Cl. ..... 124/23 R; 124/88; 124/90

[58] Field of Search ..... 124/90, 88, 23 R, 24 R, 124/86; 254/172

[56] References Cited

U.S. PATENT DOCUMENTS

| | | | |
|---|---|---|---|
| 261,610 | 7/1882 | Howe | 124/23 R |
| 2,370,783 | 3/1945 | Dritz | 124/24 R |
| 3,291,111 | 12/1966 | Smith | 124/23 R |
| 3,851,638 | 12/1974 | Alexander | 124/24 R |
| 3,945,368 | 3/1976 | Jones | 124/90 X |
| 3,958,551 | 5/1976 | Ketchum | 124/24 R |
| 4,078,538 | 3/1978 | Shepley | 124/24 R |

*Primary Examiner*—William R. Browne

*Attorney, Agent, or Firm*—George W. Price; Walter Lewis

[57] ABSTRACT

Compound bow having two eccentric wheels or cams at each end. One of the wheels may be quickly manually adjusted with respect to the other without disassembling the strung bow to adjust the magnitude of drop off at full draw without significantly changing the draw length or peak weight. Also, a ball and socket type quick connect and disconnect device is provided for dead ending the bow cables or strings to the eccentric wheels or cams.

6 Claims, 7 Drawing Figures

COMPOUND BOW

This invention relates to archery bows, and more particularly, to improvements in compound archery bows.

The invention is applicable to compound archery bows of the type shown in Allen U.S. Pat. No. 3,486,495 (1969) and Ketchum U.S. Pat. No. 3,958,551 (1976).

Briefly, in compound bows a pair of eccentric pulleys, cams, or wheels are used at each end of the bow to achieve a rapid build up to peak weight at full draw, and then there is a drop off in the amount of force required to hold the bow at full draw. The drop off makes it less tiring or easier on the bow user to hold the bow at full draw, take aim, and fire.

Making adjustments at the pulleys, cams, or wheels involves changing them which in turn involves unstringing and at least partly disassembling the bow. These steps have their obvious disadvantages.

Briefly, in our invention we provide quick connect and disconnect means for dead ending the bow cables and/or strings to the pulleys, cams, or wheels; and in addition means for quickly manually adjusting each pair of pulleys, cams, or wheels with respect to each other to adjust the amount of drop off, but without appreciably changing the draw length or peak weight, and in addition, without in any way disassembling or unstringing the bow.

Briefly, in the invention the bow string is quick connected to short length draw cables which in turn are quick dead ended to the draw length side of the pulleys, cams, or wheels by ball and socket means; and long length bow weight cables are likewise quick dead ended to the bow weight side.

Further, in the invention the two parts of each pair of double eccentric pulleys, cams, or wheels are contiguous and connected together but still separate and movable with respect to each other, and a miniature gear mechanism is provided therebetween for shifting them with respect to each other with a simple tool, such as a miniature allen wrench, and without disassembly of the parts. In particular, the bow weight side is shifted with respect to the draw length side by the miniature gear mechanism in a particular path to adjust the drop off without appreciably affecting the draw length or peak weight. In the specific embodiment of the invention to be illustrated in the accompanying drawings, the path of adjustment and provides a drop off of from 10 to 50% but within this range of adjustment the peak weight will not change more than 10% and the draw length will not change more than 1%.

Figure 1:
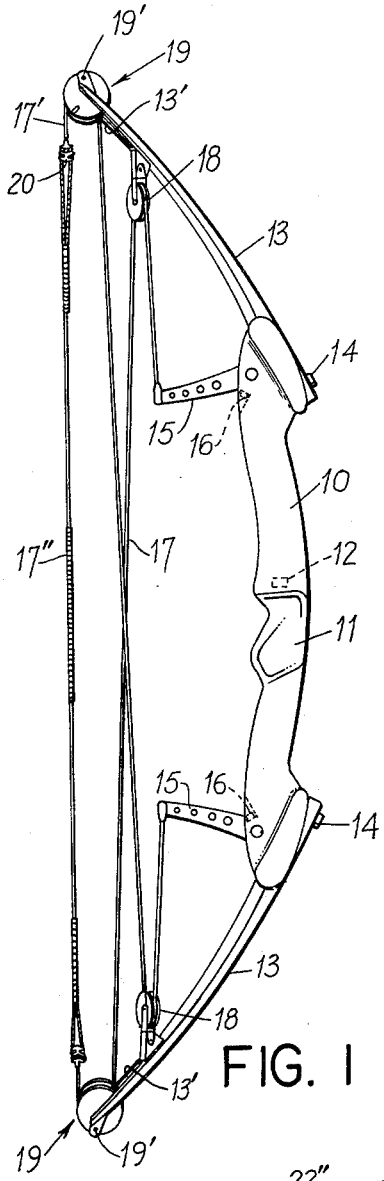

FIG. 1 Side elevation of the compound bow.

Figure 2:
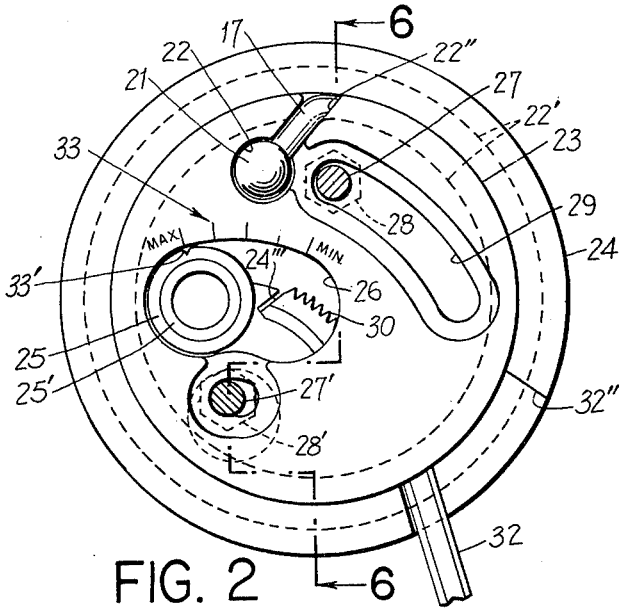

FIG. 2 Plan view of eccentric pulleys, cams, or wheels at 50% drop off.

Figure 3:
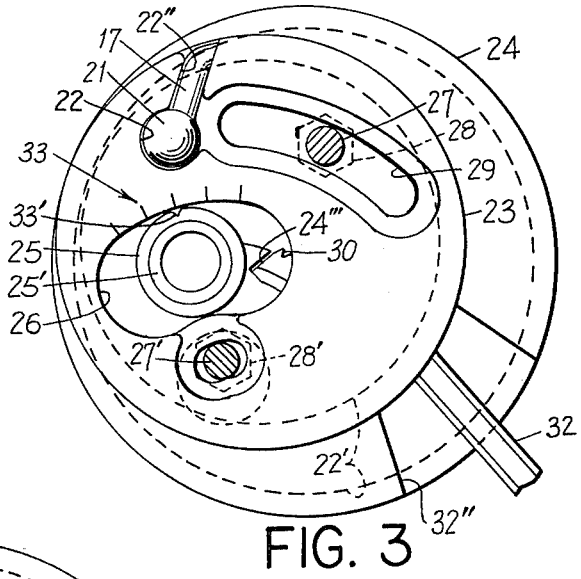

FIG. 3 Plan view of eccentric pulleys, cams or wheels at 30% drop off.

Figure 4:
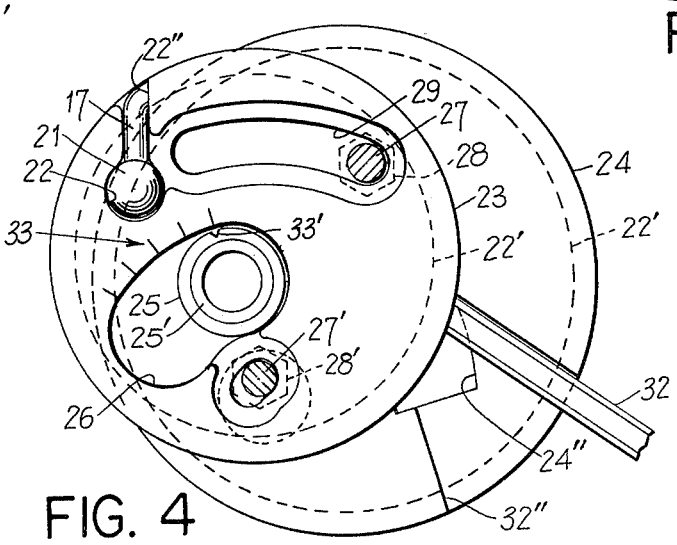

FIG. 4 Plan view of eccentric pulleys, cams or wheels at 10% drop off.

Figure 5A:
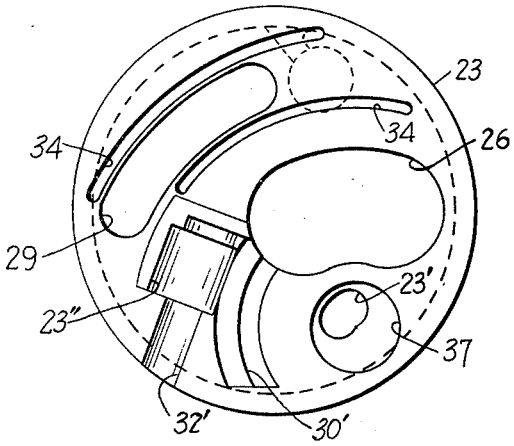

FIG. 5A Exploded plan view of one of the pulleys, cams or wheels when viewed from the inside surface.

Figure 5B:
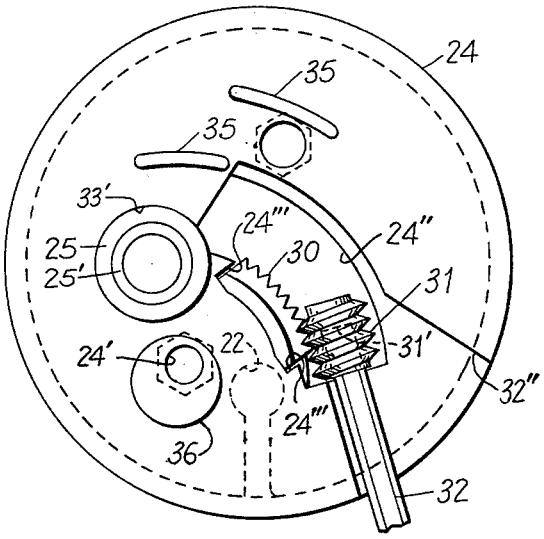

FIG. 5B Exploded plan view of the other pulley, cam or wheel when viewed from its inside surface.

Figure 6:
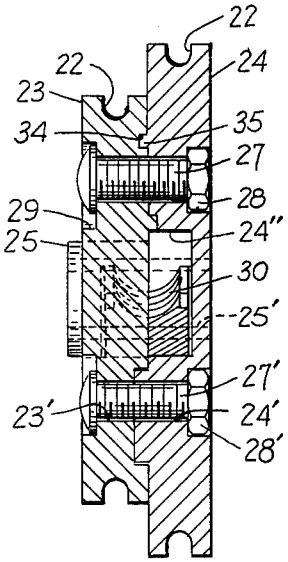

FIG. 6 Cross-sectional view taken along section line 6—6 of FIG. 2.

In the accompanying sheets of drawings, FIG. 1 is a side elevation view of a compound bow presently on the market and incorporating our inventon; FIGS. 2, 3, 4 are plan views of the eccentric pulleys, cams, or wheels when viewed from the bow weight side thereof and at the respective positions of 50, 30, and 10% drop off; FIGS. 5A, 5B are an exploded plan view of the two parts of the pulleys, cams, or wheels when viewed from their inside surfaces; and FIG. 6 is a cross-sectional view taken along the section line 6—6 of FIG. 2. The position of the parts shown in FIGS. 5A, 5B corresponds to that shown in FIG. 2.

It will be appreciated that since the sets of pulleys, cams, or wheels at opposite ends of the bow have to turn in opposite direction, they are the same except for a relative reversal; but otherwise, what is said with respect to one is equally applicable to the other. Also, these small parts have been shown in the patent drawings to scale as a true representation of an actual working model.

Turning now first to FIG. 1, the whole bow will be only briefly described, since it is well-known to those skilled in the art, and then the structure at the opposite outer extremities of the bow limbs will be described in detail since it is that area in which the invention resides. The bow comprises a rigid handle 10, having a central grip 11 and sight 12, and opposite flexible limbs 13. The inner ends of the limbs 13 are connected to handle 10 by means generally indicated by reference numeral 14 for adjusting the weight of the bow. Tuning arms 15 are pivoted to the ends of handle 10 and these also are adjustable by means indicated generally by reference numeral 16. Bow cables 17 are dead ended to arms 15 and then progress therefrom to around swivelled pulleys 18 to the smaller of the set of end pulleys, cams, or wheels 19. From there the long cables 17 continue as short cables 17' from the larger of the sets 19 to a central bow string 17''. The string 17'' is quick connected to the free ends of cables 17' by being looped at its ends on to "Christmas tree" type anchors 20. The type of adjustable connection 20 shown between parts 17' and 17'' is not part of the instant invention, but the invention of pending (and allowed) L. P. Griggs, Ser. No. 734,163 filed Oct. 20, 1976, now U.S. Pat. No. 4,079,722 granted Mar. 21, 1978, and which is assigned to the same assignee as the instant invention, which is also true of the referred to Ketchum U.S. Pat. No. 3,958,551 (1976).

Turning now also to FIGS. 2–6 for a detailed description of the instant invention, it will be seen that the long and short cables 17 and 17' are dead ended to the end sets 19 by ball and socket 21 and 22 type quick connect and disconnect means. This makes it very easy to string or unstring the bow. The balls 21 are formed on the ends of cables 17, 17' and the sockets 22 are formed in the two halves of each set 19. Each half of the sets 19 have peripherial grooves 22' for the cables 17, 17'. The grooves 22' are connected by side slots 22'' to their corresponding sockets 22. So, to connect the cables, all that need be done is to nest the balls 21 in the sockets 22 and the contiguous cable portions in the side slots 22'', which brings the cables to their grooves 22' at the periphery of the wheels. To disconnect the cables the adjustment means 14 is operated to bring the flexible limbs 13 towards each other to relax the tension on the cables and string 17, 17', 17''. When sufficiently relaxed, the string 17'' can be unhooked from anchor 20 and the balled ends of cables 17, 17' from their side slots 22'' and sockets 22.

Now for a detailed description of the two cams, pulleys, or wheels of each set 19 and their adjusting means. As shown, each set 19 comprises a small and large piece 23 and 24. Part 23 is the bow weight or take-up side of each set 19, and part 24 is the draw-length side. Part 24 has an integral hub 25 formed thereon on its inside face. Hub 25 has roller bearings 25' located therein. Hub 25 extends through part 23 through an arcuate slot 26 formed therein. Parts 23, 24 are held together by bolts 27, 27' and nuts 28, 28'. The bolt 27 extends through another arcuate slot 29 formed in part 23. The bolt 27' extends through holes 23', 24' formed in the parts 23, 24; see FIGS. 5A, 5B.

Formed on the inside face of part 24 is a chamber half 24" and on the part 23 another chamber half 23". These two chamber halves 23", 24" together close on a sector gear 30 and a meshed pinion gear 31. The sector gear 30 is captive with respect to the large wheel 24 and the pinion 31 with respect to the small wheel 23. That is to say, gear 30 does not move at all, but pinion 31 does move along gear 30 when it is turned by a miniature allen wrench 32. When pinion 31 moves, it carries small wheel 23 with it to move the small wheel 23 with respect to the large wheel 24.

The sets 19 are mounted for rotation on the outer ends of the limbs 13 on pins 19'. The outer limb ends have slots 13' which are spanned by pins 19', with sets 19 being positioned in the slots 13'. Ordinarily, the nuts and bolts 27, 28 and 27', 28' are tightened down. However, in order to make an adjustment in the percent drop off in the bow, the means 14 are first operated to relieve the tension on 17, 17', 17" and then the bolts and nuts 27, 28, 27', 28' are loosened slightly with a miniature allen wrench. Then the same kind of wrench is inserted between the parts 23, 24 into the blind hex hole 31' in pinion 31. This can be done easily since there are opposite facing slots 32', 32" formed on the inside faces of parts 23, 24 respectively leading to the chamber halves 23", 24". As the pinion 31 is turned, the part 23 pivots on an axis adjacent bolt 27' with respect to part 24 along a path as represented by the curvature of slots 26, 29. That is to say, part 24 stays put when pinion 31 is turned. However, part 23 moves, as does its slot 26 with respect to hub 25. Thus, the eccentric axis of rotation for the part 24 (hub 25 on shaft 19') does not change, but this same eccentric axis of rotation for the part 23 does change because part 23 is bodily shifted with respect thereto by the miniature gear mechanism 30, 31; compare FIGS. 2, 3, 4.

The 50, 30, 10% drop off positions of the parts is illustrated in FIGS. 2, 3, 4 respectively. It will be seen that with a 10% drop off (FIG. 4) part 23 has the least amount of eccentricity with respect to its axis of rotation 19', 25; with a 50% drop off (FIG. 2) the eccentricity is the largest, and at 30% the eccentricity is midway between the other two positions (compare FIG. 3 vs. FIGS. 2 and 4). In the 50% drop off FIG. 2 position the two circular parts 23, 24 are concentric with respect to each other. In the 10% drop off FIG. 4 position they have maximum off set with respect to each other, and in FIG. 3 the peripheries of the two circular wheels coincide at about the 10 o'clock position.

A calibrated scale 33 is provided to accurately selectively adjust the positions of the parts. The scale 33 extends along that side of slot 26 most remote from bolt 27' and is calibrated MAX to MIN with five (5) marks therebetween. There is also a mark 33' on the hub 25 just opposite scale 33 for reading the latter. In FIG. 2 mark 33' is opposite the left-hand end MAX mark on scale 33; in FIG. 4 opposite the right-hand end MIN mark; and in FIG. 3 opposite the center mark on scale 33. After the selected percent drop off is adjusted, the bolts and nuts 27, 28, 27', 28' are tightened and the means 14 are operated to retension the cables 17, 17', 17" back to original position, after which the bow is ready to use as before, but with a different percent drop off, without, however, any appreciable change in the draw length or the peak weight of the bow.

What holds the sector gear 30 captive in the chamber half 24" is a pair of integral part 24 shoulders 24"' at the opposite ends of the sector gear 30. The pinion 31 is held captive in the chamber half 23" by virtue of the fact that it is just large enough to receive pinion 31 and to permit it to turn but not move endwise with respect thereto. Matching arcuate guide grooves and lugs 34, 35 are formed on the inside faces of the parts 23 and 24 respectively. As the pinion 31 moves along the gear 30, its angular disposition changes, since gear 30 is arcuate. That is to say, the slot 32' sweeps along the slot 32". This is why the slot 32" is angular. That is, to make it possible to insert the allen wrench 32 into blind hex hole 31' regardless of the position of pinion 31. The bottom of the chamber half 23" of course is slotted along an arc 30' corresponding to the curvature of sector gear 30 and opens into slot 26 so that the bottom of the pinion 31 can engage the sector gear 30 and the part 23 clear the gear 30 as it moves through its arc with respect to part 24. Some grease can be packed into the chamber defined by chamber halves 23", 24" to keep the movable gear parts lubricated.

In the invention all parts of the piece 23 trace small arcs relative the piece 24 during the adjustment, and a point of rotation is selected on which to pivot piece 23 relative piece 24. Thus, a circular boss 36 is formed at bolt 27' on the inside face of piece 24, boss 36 being received in a blind bore 37 formed on the inside face of piece 23. The bolt 27' and its holes 23', 24' are slightly off center with respect to the circular pieces 36, 37. Bolt 27' is snug in the hole 24' but loose in the hole 23' since it is arcuate. All the arcuate parts such as slot 26, slot 29, sector gear 30, grooves 34, lugs 35, slot 30' and arcuate hole or slot 23' are formed by radii off the center of boss 36. Boss 36 is formed at about the 7 o'clock position, and the piece 23 is pivoted about the boss 36 through an angle of about 45 degrees. In this way, and considering the geometry shown, piece 23 has arcuate movement with respect to piece 24. After the adjustment is made, the bolts and nuts 27, 28; 27', 28' are tightened down to affix opposite sides of the two pieces 23, 24 together to hold the adjustment.

We claim:

1. In a compound archery bow comprising a pair of pulley wheels a rigid handle having flexible limbs connected thereto and means comprising bow cables and a central bow string connected to the outer ends of said limbs by said pair of pulley wheels at each of said ends for providing a drop off from the peak weight of said bow at full draw of said string, a shaft, said wheels being eccentrically mounted in contiguous side-by-side relationship on a common shaft for simultaneous eccentric rotation with respect to said shaft; the improvement comprising a means for selectively adjusting the eccentric disposition of one of said wheels with respect to said shaft, said selectively adjusting means comprising miniature gear means positioned between said wheels.

2. In a bow, as in claim 1, said gear means comprising a gear sector and a pinion gear rotatably movable therealong, said one wheel being connected to said pinion for movement therewith, and said gear sector being affixed to the other wheel whereby rotation of said pinion gear is operable to change the disposition of said one wheel with respect to the other wheel.

3. In a bow, as in claim 2, means including said gear means for moving said one wheel with respect to the other along an arcuate path comprising guide slots on said one wheel and protruding means on the other wheel extending into said guide slots, said other wheels on said bow comprising the draw length side of said pairs of pulley wheels and having said string connected thereto, said one wheel on said bow comprising the bow weight side of said pairs of pulley wheels and having said cables connected thereto, whereby said gear means is operative to alter said drop off by from 10 to 50% of said peak weight without significantly altering either the draw length or peak weight of said bow at full draw.

4. In a bow, as in claim 1, chambers formed in the contiguous facing sides of said wheels, said facing sides being in engagement with each other, said gear means being captive mounted in said chambers, and an opening formed between the facing sides of said wheels affording access to said gear means to manually rotate the same with a miniature tool.

5. In a compound archery bow having an eccentric cable pulley, a cable connected to said pulley, and means for changing the eccentricity of said pulley, a socket formed on said pulley, a ball formed on said cable, said ball being removably nested in said socket for quick disconnect of said cable from said pulley, and said means comprising a slot in said pulley, the eccentric axis of said pulley being aligned with said slot, and manually operable gear means contiguous and connected to said pulley for quick shift of said pulley with respect to said axis.

6. In a compound archery bow having a pair of side-by-side eccentric pulley wheels for providing a drop off in said bow at full draw, means for adjusting the magnitude of said drop off without significantly changing the draw length or peak weight of said bow at full draw, said means comprising manually operable mechanism for shifting said wheels with respect to each other along an arcuate path, said mechanism comprising miniature gear means between said wheels, said gear means being adapted to shift one of said wheels with respect to the other whereby said one wheel has a change in its axis of eccentricity from that of the other wheel, and guide means between said two wheels for guiding said one wheel along said path.

* * * * *